United States Patent [19]

Christian et al.

[11] 4,431,555

[45] Feb. 14, 1984

[54] OXIDATION STABLE POLYFLUOROALKYLETHER GREASE COMPOSITIONS

[75] Inventors: John B. Christian, Yellow Springs; Christ Tamborski, Dayton, both of Ohio

[73] Assignee: The United States of America as represented by the Secretary of the Air Force, Washington, D.C.

[21] Appl. No.: 418,106

[22] Filed: Sep. 14, 1982

[51] Int. Cl.[3] ..... C10M 3/24

[52] U.S. Cl. ..... 252/49.9

[58] Field of Search ..... 252/49.9

[56] References Cited

U.S. PATENT DOCUMENTS

| | | | |
|---|---|---|---|
| 3,306,855 | 2/1967 | Borecki | 252/49.9 |
| 3,393,151 | 7/1968 | Dolle et al. | 252/49.9 |
| 3,481,872 | 12/1969 | Dolle et al. | 252/49.9 |
| 3,483,129 | 12/1969 | Dolle et al. | 252/49.9 |
| 3,499,041 | 3/1970 | Tamborski | 260/612 |
| 3,567,802 | 3/1971 | Garth | 260/950 |
| 3,725,273 | 4/1973 | Christian | 252/13 |
| 4,011,267 | 3/1977 | Tamborski et al. | 260/606.5 P |
| 4,043,926 | 8/1977 | Snyder et al. | 252/49.9 |
| 4,097,388 | 6/1978 | Snyder et al. | 252/49.9 |
| 4,132,660 | 1/1979 | Christian et al. | 252/51.5 R |
| 4,324,673 | 4/1982 | Christian et al. | 252/51.5 R |

*Primary Examiner*—Jacqueline V. Howard

*Attorney, Agent, or Firm*—Donald J. Singer; Charles E. Bricker

[57] ABSTRACT

A grease composition comprising a major amount of a polyfluoroalkylether base fluid of the general formula $$C_3F_7[CF(CF_3)CF_2)]_nCF_2CF_3 \quad (a)$$

wherein n is an integer having a value in the range of 5 to 50, or $$F[CF(CF_3)CF_2O]_pCHFCF_3 \quad (b)$$

wherein p is an integer having a value of 1 to 17, a minor amount of a thickener and an oxidation inhibiting amount of a perfluoroalkylether phenylphosphine of the general formula $$(O)_a—P-(Ar-CF_2-R_fOR_f)_3$$

wherein a has a value of zero or 1, Ar is a phenylene or perfluorophenylene group, and $—R_fOR_f$ is a perfluoroalkylether group containing at least one ether linkage.

10 Claims, No Drawings

OXIDATION STABLE POLYFLUOROALKYLETHER GREASE COMPOSITIONS

RIGHTS OF THE GOVERNMENT

The invention described herein may be manufactured and used by or for the Government of the United States for all governmental purposes without the payment of any royalty.

BACKGROUND OF THE INVENTION

This invention relates to grease compositions.

Primarily because of their thermal stability, it has been recognized that polyfluoroalkylether fluids have great potential for use as lubricants. The prior art discloses greases formulated from such fluids and thickeners such as a fluorinated copolymer of ethylene and propylene or a polymer of tetrafluoroethylene. These greases have proven to be useful over a wide range of temperatures, e.g., as low as −40° F. and as high as 600° F. Although such greases have been found to possess superior lubricating characteristics for short periods of time, their utility has been limited by their inability to provide long term high temperature stability in an oxidizing atmosphere.

Accordingly, it is an object of this invention to provide a novel grease composition based upon a polyfluoroalkylether fluid.

Other objects and advantages of the present invention will become apparent to those skilled in the art upon consideration of the following disclosure.

DESCRIPTION OF THE INVENTION

In accordance with the present invention there is provided a grease composition comprising a major amount of polyfluoroalkylether base fluid, a minor amount of a thickener and an oxidation inhibiting amount of a perfluoroalkylether phenylphosphine.

The polyfluoroalkylether base fluid employed in the grease compositions of the present invention may have the general formula $$C_3F_7[CF(CF_3)CF_2O]_nCF_2CF_3 \quad \text{(a)}$$

wherein n is an integer having a value ranging from 5 to 50, preferably 10 to 40 or $$F[CF(CF_3)CF_2O]_pCHFCF_3 \quad \text{(b)}$$

wherein p is an integer having a value of 1 to 17.

The value of n of compound (a) is usually such that the base fluid has a kinematic viscosity ranging from about 18 to 320 centistokes (cs), preferably about 270 cs, at 100° F. The compound (a) is available commercially from E. I. duPont de Nemours and Company, Wilmington, Del., under the trademark Krytox.

The compound (b) may be one or more of a homologous series of hydrogen-containing fluorinated ethers. A series of such fluids is available from E. I. duPont de Nemours and Company, Wilmington, Del., under the trademark "Freon E". In the presently available series of "Freon E" fluids, the number in the name corresponds to the p in the formula. Thus, any particular homolog such as Freon E-7 can vary in the composition of its mixture so long as the average p corresponds to the number in its name.

As a thickener, it is generally preferred to employ a fluorinated ethylene-propylene copolymer (FEP) or a polytetrafluoroethylene (PTFE). The copolymer usually has a molecular weight in the approximate range of 120,000 to 190,000, preferably about 140,000 to 160,000, a density of about 2.39 to 2.47 g/cc, a surface area of about 10.0 $m^2/g$, and a particle size of about 0.15 micron. The polytetrafluoroethylene usually has a molecular weight in the approximate range of 2000 to 50,000, preferably about 10,000 to 50,000, a density of about 2.15 to 2.28 g/cc, a surface area of 7–8 $m^2/g$, and a particle size of 1–2 microns. These polymeric thickeners are well known materials and will not be further discussed.

The antioxidant employed in the greases of this invention has the general formula $$(O)_a\text{-}(P\text{—}Ar\text{—}CF_2\text{—}R_fOR_f)_3$$

where a has a value of 0 or 1, Ar is a phenylene group or a perfluorophenylene group, and $—R_fOR_f$ is a perfluoroalkylether group containing at least one ether linkage. Examples of such $—R_fOR_f$ groups include the following:

$$—CF(CF_3)[OCF_2CF(CF_3)]_xOC_3F_7,$$

$$—CF_2(OCF_2CF_2)_yOC_2F_5, \text{ and}$$

$$—CF_2(OCF_2)_zOCF_3,$$

where x, y and z are zero or an integer having a value of 1 to 20, preferably 1–4.

The antioxidant compounds of the above formula in which Ar is a phenylene group and a is zero are new compounds. A detailed description of the synthesis of these compounds is contained in application Ser. No. 418,115, filed of even date herewith by C. Tamborski, C. E. Snyder, Jr., and J. B. Christian, the disclosure of which is incorporated herein by reference.

The grease compositions of the present invention comprise about 68 to 72 weight percent of the base fluid described previously, about 27 to 32 weight percent of thickener, and about 1 to 3 weight percent of the above described antioxidant, all based upon the total weight of compounded grease.

The following example illustrates the invention.

EXAMPLE

A series of grease compositions were prepared using as antioxidants the following:

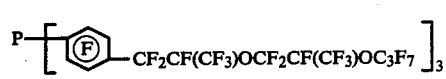

(A)

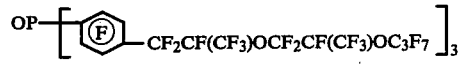

(B)

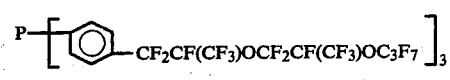

(C)

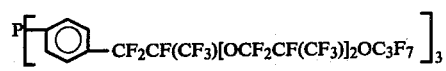

(D)

These antioxidants are designated AO-A, AO-B, AO-C and AO-D, respectively, in the Table below.

The base fluid had the formula (a) given previously. This base fluid had a viscosity of about 270 cs at 100° F.; it is available commercially under the trademark Krytox 143AC.

The thickeners employed were (a) FEP having an average molecular weight of 150,000, available under the designation TL-120 from Liquid Nitrogen Processing Co., Malvern, Pa., and (b) PTFE having a molecular weight of 30,000, available under the designation TL-102 from the same source.

The grease compositions were prepared by mixing and stirring each of the recipes set forth in the following Table until a uniform mixture was obtained (amounts given are in weight percent). Each mixture was further blended to a grease consistency by passing each mixture twice through a 3-roll mill at about 77° F. with the rollers set at an opening of 0.0015 to 0.002 inch.

The various grease compositions were tested in accordance with standard test procedures. The penetration test was carried out as prescribed by Federal Test Method Standard 791*a*, Method 313. The evaporation test was carried out as prescribed by ASTM Method D 2595. The results of these tests are given in the following Table.

TABLE

| Run No. | 1 | 2 | 3 | 4 | 5 | 6 | 7 | 8 | 9 |
|---|---|---|---|---|---|---|---|---|---|
| Base Fluid | 69 | 68 | 69 | 68 | 69 | 68 | 69 | 68 | 69 |
| FEP | 30 | 29 | — | — | 30 | 20 | — | — | 30 |
| PTFE | — | — | 30 | 29 | — | — | 30 | 29 | — |
| AO-A | 1 | 3 | 1 | 3 | | | | | |
| AO-B | | | | | 1 | 3 | 1 | 3 | |
| AO-C | | | | | | | | | 1 |
| AO-D | | | | | | | | | |
| Penetration, decimillimeters | 281 | 282 | 286 | 290 | 286 | 286 | 290 | 292 | 269 |
| Evaporation at 450° F. (%) | | | | | | | | | |
| 22 hrs | 3.9 | 4.2 | 3.8 | 3.7 | 4.0 | 4.1 | 3.9 | 4.1 | 4.3 |
| 72 hrs | 6.5 | 6.8 | 6.8 | 6.6 | 6.7 | 6.4 | 6.7 | 6.5 | 7.2 |
| 168 hrs | 7.3 | 7.7 | 7.0 | 6.9 | 7.0 | 7.3 | 8.0 | 7.8 | 10 |
| 336 hrs | 10 | 10 | 10 | 10 | 11 | 11 | 10 | 12 | 13 |
| Condition of grease at end of test | ← | ← | ← | ← | Soft | → | → | → | → |

| Run No. | 10 | 11 | 12 | 13 | 14 | 15 | 16 | Control |
|---|---|---|---|---|---|---|---|---|
| Base Fluid | 68 | 69 | 68 | 69 | 68 | 69 | 68 | 70 |
| FEP | 29 | — | — | 30 | 29 | — | — | — |
| PTFE | — | 30 | 29 | — | — | 30 | 29 | 30 |
| AO-A | | | | | | | | |
| AO-B | | | | | | | | |
| AO-C | 3 | 1 | 3 | | | | | |
| AO-D | | | | 1 | 3 | 1 | 3 | |
| Penetration, decimillimeters | 272 | 270 | 271 | 288 | 293 | 290 | 289 | 300 |
| Evaporation at 450° F. (%) | | | | | | | | |
| 22 hrs | 4.5 | 4.2 | 4.5 | 2.0 | 2.0 | 2.0 | 2.0 | 4.7 |
| 72 hrs | 7.2 | 7.0 | 6.9 | 2.1 | 2.1 | 2.0 | 2.1 | 11.0 |
| 168 hrs | 10 | 9.9 | 10 | 2.3 | 2.4 | 2.2 | 2.4 | 16.8 |
| 336 hrs | 12 | 12 | 12 | 5.1 | 5.0 | 5.4 | 5.1 | 22.0 |
| Condition of grease at end of test | ← | ← | ← | Soft | → | → | → | Hard |

The above data illustrate the high temperature oxidative stability of the grease compositions of this invention.

Modifications of the invention can be made in view of the foregoing disclosure without departing from the spirit of the invention and the scope of the following claims.

We claim:

1. A grease composition comprising a major amount of a polyfluoroalkylether base fluid having the general formula $$C_3F_7[CF(CF_3)CF_2O]_nCF_2CF_3 \quad (a)$$

wherein n is an integer having a value in the range of 5 to 50, or $$F[CF(CF_3)CF_2O]_pCHFCF_3 \quad (b)$$

wherein p is an integer having a value of 1 to 17, a minor amount of a thickener and an oxidation inhibiting amount of a perfluoroalkylether phenylphosphine of the general formula $$P(Ar—CF_2—R_fOR_f)_3$$

wherein Ar is a phenylene group and $—R_fOR_f$ is a perfluoroalkylether group containing at least one ether linkage.

2. The composition of claim 1 wherein said base fluid has the formula (a).

3. The composition of claim 1 wherein said base fluid has the formula (b).

4. The composition of claim 1 wherein $—R_fOR_f$ is selected from the group consisting of $$—CF(CF_3)[OCF_2CF(CF_3)]_xOC_3F_7,$$

$$—CF_2(OCF_2CF_2)_yOC_2F_5, \text{ and}$$

$$—CF_2(OCF_2)_zOCF_3$$

wherein x, y and z each has a value in the range of 1 to 20.

5. The composition of claim 1 wherein the amount of base fluid is in the approximate range of 68 to 72 weight percent, the amount of thickener is in the approximate range of 27 to 32 weight percent and the amount of said phosphine 1 to 3 weight percent.

6. The composition of claim 1 wherein said thickener is selected from the group consisting of fluorinated ethylene-propylene copolymer having a molecular weight of about 120,000 to 190,000 and polytetrafluoroethylene having a molecular weight of about 2,000 to 50,000.

7. The composition of claim 2 wherein said base fluid has a viscosity of about 270 cs at 100° F., said thickener is fluorinated ethylene-propylene copolymer and said phosphine has the formula

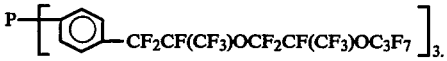

8. The composition of claim 2 wherein said base fluid has a viscosity of about 270 cs at 100° F., said thickener is polytetrafluoroethylene and said phosphine has the formula

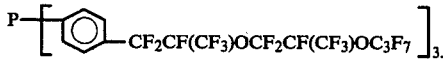

9. The composition of claim 2 wherein said base fluid has a viscosity of about 270 cs at 100° F., said thickener is fluorinated ethylene-propylene copolymer and said phosphine has the formula

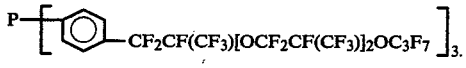

10. The composition of claim 2 wherein said base fluid has a viscosity of about 270 cs at 100° F., said thickener is polytetrafluoroethylene and said phosphine has the formula

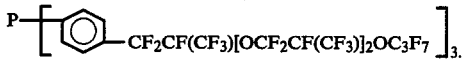

* * * * *

UNITED STATES PATENT AND TRADEMARK OFFICE

CERTIFICATE OF CORRECTION

PATENT NO. : 4,431,555

DATED : February 14, 1984

INVENTOR(S) : John B. Christian and Christ Tamborski

It is certified that error appears in the above—identified patent and that said Letters Patent is hereby corrected as shown below:

Col. 2, line 18; $(O)_a\{P\text{-}Ar\text{-}CF_2\text{-}R_fOR_f)_3$ should read $(O)_a\text{-}P\{Ar\text{-}CF_2\text{-}R_fOR_f)_3$.

Signed and Sealed this

Tenth Day of July 1984

[SEAL]

Attest:

GERALD J. MOSSINGHOFF

Attesting Officer

Commissioner of Patents and Trademarks